United States Patent [19]

Geary et al.

[11] Patent Number: 4,664,071

[45] Date of Patent: May 12, 1987

[54] THERMAL SIPHON ADAPTER

[75] Inventors: William C. Geary, Broken Arrow; Leland M. Zabel, Tulsa, both of Okla.

[73] Assignee: Arrow Specialty Company, Tulsa, Okla.

[21] Appl. No.: 676,474

[22] Filed: Nov. 29, 1984

[51] Int. Cl.[4] ..... F01P 3/22

[52] U.S. Cl. ..... 123/41.1; 123/41.18; 123/41.27; 165/137

[58] Field of Search ..... 123/41.01, 41.18, 41.2, 123/41.27, 41.08, 41.09, 41.1; 165/137, 128, 104.19, 121, 104.32, 104.21, 148; 220/202, 203; 236/34, 34.5

[56] References Cited

U.S. PATENT DOCUMENTS 4,209,063 6/1980 Babish et al. ..... 123/41.01
4,358,051 11/1982 Hunt ..... 123/41.1
4,434,750 3/1984 Edelmann ..... 236/34.5

FOREIGN PATENT DOCUMENTS 2653610 6/1977 Fed. Rep. of Germany ..... 236/34.5
2400110 4/1979 France ..... 236/34.5

*Primary Examiner*—William A. Cuchlinski, Jr.
*Attorney, Agent, or Firm*—Steven L. Permut; Edgar A. Zarins

[57] ABSTRACT

An adapter for converting a condenser into a thermal siphon radiator includes a housing that has an outlet port connected to the fill inlet of the condenser, a side inlet port connected to a conduit and a fill inlet that is sealingly engaged to a radiator cap. The radiator cap has a valve element that seats against a sealing surface in the adapter. The surface is interposed between the inlet and the two ports. In addition, an overflow and return port is positioned above the sealing surface and is connected to a reservoir.

7 Claims, 4 Drawing Figures

THERMAL SIPHON ADAPTER

TECHNICAL FIELD

This invention relates to cooling systems for internal combustion engines and more particularly, to an adapter for converting cooling condensers into cooling radiators.

DISCLOSURE INFORMATION

Many internal combustion engines particularly in the oil field equipment industry have used condensers for cooling the engine. Coolant is heated by the engine, evaporates and rises into the condenser where it is cooled by the condenser, condenses back into liquid form, and drips back to the engine to be recycled. However, condensers become inoperable because their passageways become obstructed due to deposits, corrosion, and rust. A significant part of the deterioration is caused by oxidation on the interior surfaces of the condenser. The interior of the condenser is exposed to air which allows for oxidation of the interior metal parts.

Thermal siphon radiators can also be used in the cooling system for an internal combustion engine. Thermal siphon radiators have a top inlet that receives coolant from the engine and a lower outlet that returns the cooled coolant to the engine. Circulation of the coolant proceeds down the radiator since as the coolant cools it becomes denser and sinks, thereby forcing circulation from the upper inlet through the radiator, the lower outlet, the engine, and back to the upper inlet. Thermal siphon radiators are filled with coolant so oxidation is significantly reduced within the radiator as compared to the condenser.

Furthermore, overflow and return reservoir systems can be attached to the cooling system which eliminate trapped air within the radiator and provide for the expansion and contraction of the coolant.

However, even through thermal siphon radiators are clearly advantageous over condensers, replacement of the condenser is an expensive proposition. Therefore, many operators continue to use the condenser until it is unsuitable for operation. In the meantime, the operator runs the risk of overheating and destroying the engine.

What is needed is an adapter that will inexpensively convert a condenser into a radiator so that further interior deterioration of the cooling system is reduced.

SUMMARY OF THE INVENTION

In accordance with the invention, an adapter for converting a condenser into a radiator includes a housing having an outlet port, an inlet port and a fill inlet. The outlet port is constructed to be sealingly connected to the condenser fill port. The inlet port is constructed to be sealingly connected to a hose that carries heated coolant from an internal combustion engine. The fill inlet is constructed to sealingly receive a radiator cap. An internal passage through the housing fluidly connects the outlet port to the inlet port and fill inlet.

Preferably, the passage is circumscribed by a sealing surface for seating a sealing ring of the radiator cap. The sealing surface is interposed between the fill inlet and the ports. An overflow port is preferably positioned between the fill inlet and the sealing surface. The overflow port can be attached to a reservoir container and can also function as a return port during contraction of the coolant.

Preferably, a lip surrounds the fill inlet and is constructed to engage radially extending flanges of the radiator cap.

In one embodiment, the outlet port is positioned at the bottom of the housing. The inlet port is positioned at the side of the housing and the fill inlet is located at the top of the housing.

The adapter easily converts the condenser into a radiator. The adapter has its outlet port connected to the fill inlet of the condenser. The outlet port has a connecting flange similar to that of a cap which engages the lip surrounding the fill inlet of the condenser. A radiator hose is then mounted between the engine and the inlet port. The cooling system is then filled with coolant through the fill inlet of the adapter. A radiator cap is then sealingly mounted onto the fill inlet of the adapter. An optional reservoir can be mounted adjacent the internal combustion engine which has a conduit attached to the overflow port. The condenser is now operational as a thermal siphon radiator, circulating the coolant therein.

BRIEF DESCRIPTION OF THE DRAWINGS

Reference now will be made to the accompanying drawings in which.

DETAILED DESCRIPTION OF THE PREFERRED EMBODIMENTS

Figure 1:
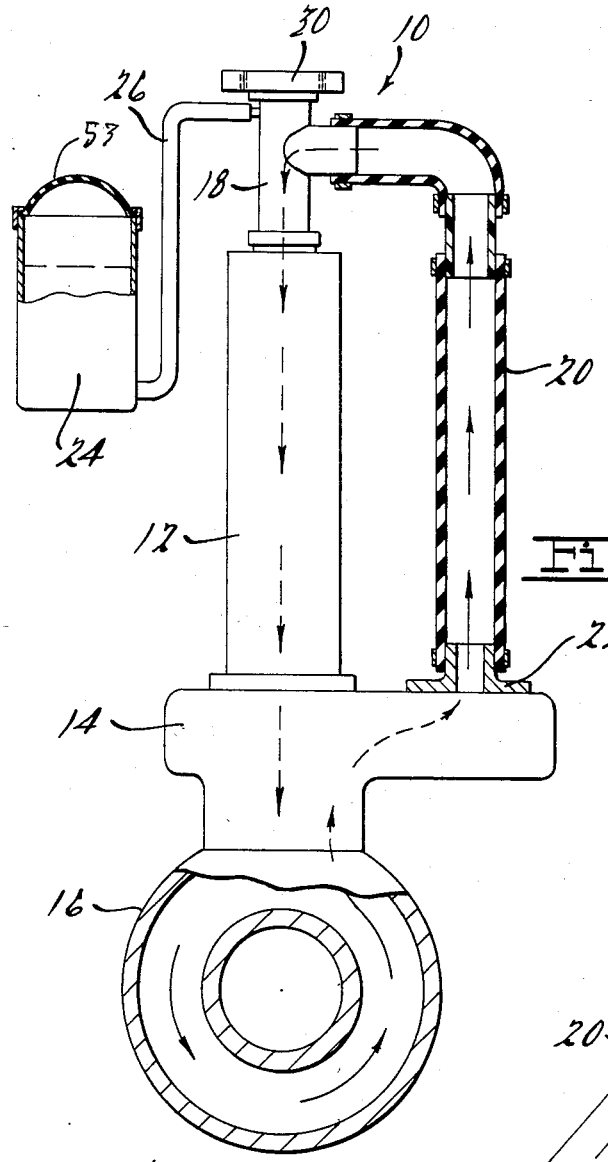
FIG. 1 is a side elevational partially segmented view of a thermal siphon radiator system using an adapter according to the invention.

Referring particularly to FIG. 1, a thermal siphon cooling system indicated as 10 includes a condenser 12 mounted on top of a hopper 14 of engine 16. An adapter member 18 is mounted on top of condenser 12. A conduit 20 is connected to hopper outlet 22 and to the adapter 18. A reservoir 24 has overflow and return conduit 26 also connected to adapter 18. Radiator cap 30 fits on top of adapter 18.

Figure 2:
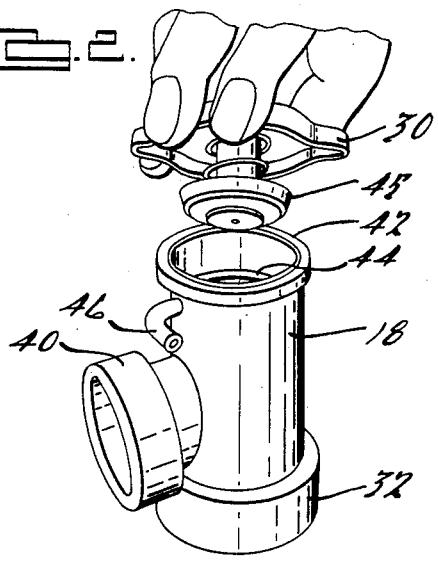
FIG. 2 is an enlarged perspective view of the adapter shown in FIG. 1 with the radiator cap removed.
Figure 3:
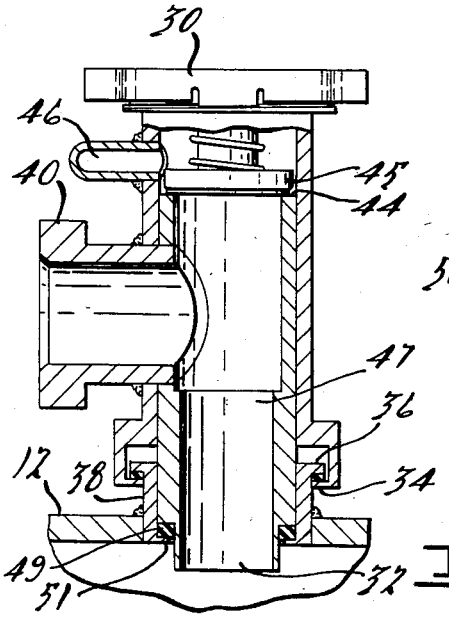
FIG. 3 is a side elevational and cross sectional view of the adapter shown in FIG. 2.

More particularly referring to FIGS. 2 and 3, the adapter 18 has a bottom outlet port 32 having flanges 34 that interconnect with the flanges 36 circumscribing the fill inlet 38 of condenser 12 such that the adapter is sealingly fitted thereto. A seal 49 can be seated on seat 51 of condenser 12 to assure a leakproof fit. The adapter can be machined with the ports welded thereon. Alternatively, the adapter can be integrally casted or pieced together from preformed tubing.

The adapter 18 also has an inlet port 40 extending from its side that is sealingly connected to conduit 20. Fill inlet 42 is located at the top and is adapted to receive cap 30. A sealing surface or shoulder 44 is interposed between the inlet 42 and the ports 40 and 32 that sealingly seats seal and valve mechanism 44 of radiator cap 30. An overflow and return port 46 is positioned above the sealing surface 44 and is connected to the overflow and return conduit 26.

In order to convert the condenser into a thermal siphon radiator, the adapter 18 should first have its outlet 32 connected to the fill inlet 38. After that, conduit 20 is connected to the inlet port 40 and also connected to the hopper 14 of engine 16. The overflow and return port 46 should then be connected to the reservoir conduit 26. At this time, the condenser 12 can be filled with coolant. After filling of the condenser 12, the radiator cap 30 can be inserted to close off the fill inlet 42 and the thermal siphon radiator system 10 is then operational to cool off engine 16.

During expansion of the coolant during heating thereof, the pressure in the radiator may become greater than a predetermined pressure so that the sealing and valve element 45 of the radiator cap opens to allow the expanding liquid to flow out through overflow and return port 46 to reservoir 24. Normally, heated coolant flows up through conduit 20 into inlet 40 through passage 47 to outlet 32 and then down through condenser 12 back to the engine 16. The coolant cycles in this fashion because the coolant becomes slightly heavier in condenser 12 due to the cooling thereof. After the engine is shut down and the coolant contracts, the sealing and valve element 45 allows for return of coolant from reservoir 24 through the overflow and return port 46. The reservoir 24 can have a flexible diaphragm cover 53 to prevent evaporation of the coolant while providing for supplying and withdrawal of coolant from the reservoir at near atmospheric pressure.

Figure 4:
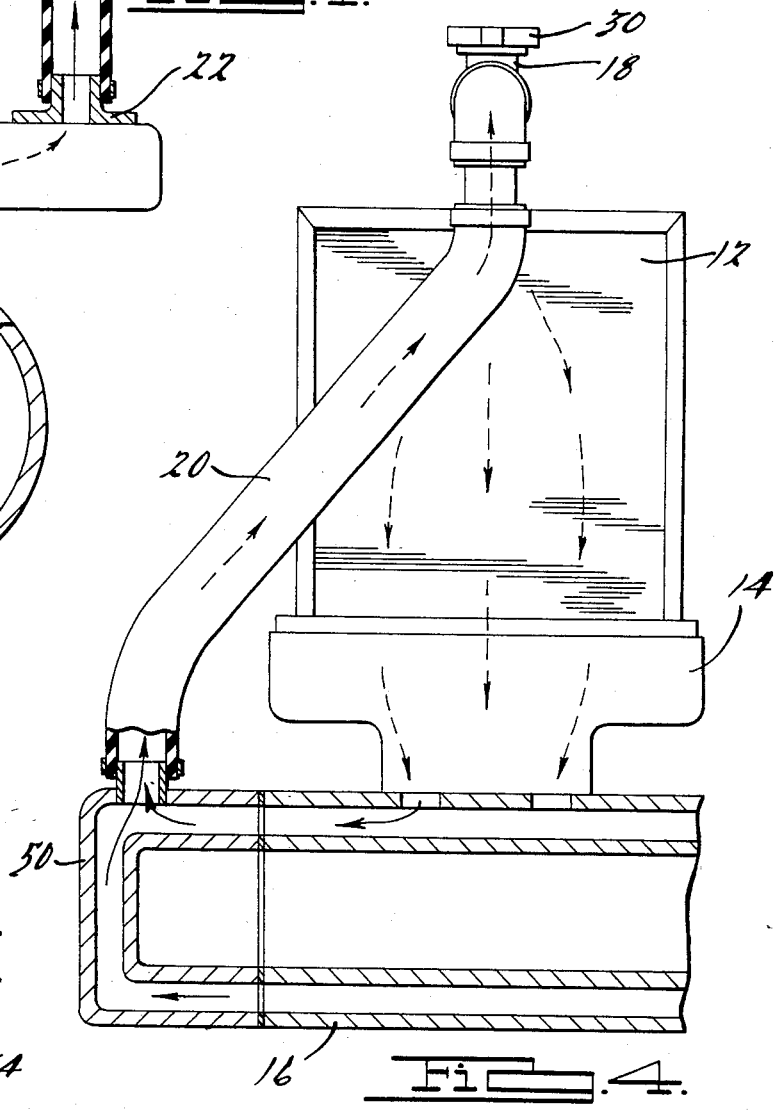
FIG. 4 is a front elevational partially segmented view of a second embodiment of the thermal siphon radiator system using the adapter according to the invention.

Referring to FIG. 4, the conduit 20 can be alternatively directly hooked to the cylinder head 50 of engine block 16. Coolant cycles in the same fashion as in the first embodiment with the heated coolant flowing through the conduit 20 to the inlet 40 and then back down through the condenser 12. After coolant passes through the condenser 12, it passes down through the hopper 14 and through the engine block 16 back to the cylinder head 50.

In this fashion, a condenser 12 is easily converted to a thermal siphon radiator system by the addition of the adapter 18 directly connected to the fill inlet 38 of the condenser 12. The adapter 18 provides for easy and inexpensive conversion of condensers 12 to a more efficient thermal siphon radiator system. In addition, the adapter provides for increased useful life of the condenser 12 in a radiator thermal siphon cooling system.

Variations and modifications of the present invention are possible without departing from the scope and spirit as defined in the appended claims.

The embodiments of the invention in which an exclusive property or privilege is claimed are defined as follows:

1. An adapter for converting a condenser into a radiator, said adapter characterized by:

a housing having an outlet port, inlet port and fill inlet;

said outlet port being located at a bottom end of said housing and directly and sealingly connected to a fill port of the condenser;

said inlet port being located at a side of said housing and sealingly connected to a hose that carries heated coolant from an engine;

said fill inlet sealingly receiving a radiator cap;

overflow port means connected to said housing; and an internal passage fluidly connecting the outlet port, inlet port, overflow means, and fill inlet.

2. An adapter as defined in claim 1 further characterized by:

said passage circumscribed by a sealing surface for sealing against a portion of said radiator cap;

said sealing surface being interposed between said fill inlet and said ports.

3. An adapter as defined in claim 2 wherein said overflow port means comprises an overflow port positioned between said fill inlet and said sealing surface.

4. An adapter as defined in claim 3 further characterized by:

a lip surrounding said fill inlet constructed to engage radially extending flanges of said radiator cap.

5. An adapter for converting a condenser into a thermal siphon radiator, said adapter characterized by:

a housing having a bottom outlet port, a side inlet port, overflow and return flow means, and a top fill inlet;

said outlet port being located at a bottom end of said housing and directly and sealingly connected to a fill port of the condenser;

said inlet port being located at a side of said housing and sealingly connected to a hose that carries heated liquid from an engine;

said fill inlet sealingly receiving a radiator cap; and an internal passage fluidly connecting the outlet, side inlet, overflow means, and fill inlet.

6. An adapter as defined in claim 5 further characterized by:

said passage circumscribed by a sealing surface positioned below said fill inlet and above said ports.

7. An adapter as defined in claim 6 wherein said overflow and return flow means comprises an overflow port positioned below said fill inlet and above said sealing surface.

* * * * *